US008047556B2

(12) United States Patent
Jang et al.

(10) Patent No.: US 8,047,556 B2
(45) Date of Patent: Nov. 1, 2011

(54) BOARD WHERE THE VOLUNTARY ADVANCE IS POSSIBLE

(75) Inventors: Byung Soo Jang, Seoul (KR); Byung Taek Jang, Seoul (KR)

(73) Assignee: Trisports Co., Ltd., Seoul (KR)

( * ) Notice: Subject to any disclaimer, the term of this patent is extended or adjusted under 35 U.S.C. 154(b) by 453 days.

(21) Appl. No.: 12/297,132

(22) PCT Filed: Apr. 12, 2007

(86) PCT No.: PCT/KR2007/001780

§ 371 (c)(1),
(2), (4) Date: Oct. 14, 2008

(87) PCT Pub. No.: WO2007/117125

PCT Pub. Date: Oct. 18, 2007

(65) Prior Publication Data

US 2009/0200764 A1 Aug. 13, 2009

(30) Foreign Application Priority Data

Apr. 12, 2006 (KR) ..... 10-2006-0033378

(51) Int. Cl.
*B62M 1/00* (2010.01)

(52) U.S. Cl. ..... 280/87.042; 280/87.05; 280/87.041

(58) Field of Classification Search ..... 280/87.01, 280/87.021, 87.041, 87.05, 11.26
See application file for complete search history.

(56) References Cited

U.S. PATENT DOCUMENTS

| | | | | |
|---|---|---|---|---|
| 4,955,626 | A * | 9/1990 | Smith et al. | 280/87.042 |
| 6,273,440 | B1 * | 8/2001 | Wilson | 280/87.042 |
| 2007/0114743 | A1 * | 5/2007 | Chen | 280/87.042 |

FOREIGN PATENT DOCUMENTS

| | | | |
|---|---|---|---|
| KR | 10-0472049 | B1 | 3/2005 |
| KR | 10-0505754 | B1 | 8/2005 |
| KR | 10-2006-0028452 | A | 3/2006 |

* cited by examiner

*Primary Examiner* — J. Allen Shriver, II
*Assistant Examiner* — Katy Meyer
(74) *Attorney, Agent, or Firm* — Sughrue Mion, PLLC

(57) ABSTRACT

Disclosed herein is a board capable of voluntary forward movement. The board comprises: a pair of front and rear boards, each of which is integrated with a connecting step formed on its lower surface and has a connecting hole formed within the connecting step; a connecting assembly including a connecting pipe inserted into the connecting holes, fixing blocks rotatably coupled to both ends of the connecting pipe to integrally connect the front board and the rear board, each of the fixing blocks having a track groove, and coupling pins inserted into the track grooves through the connecting pipe to be in association with the connecting pipe so that the front and rear boards are rotated within limited angle ranges corresponding to predetermined widths of the track grooves; and voluntary advancement assemblies.

11 Claims, 16 Drawing Sheets

【FIG.1】
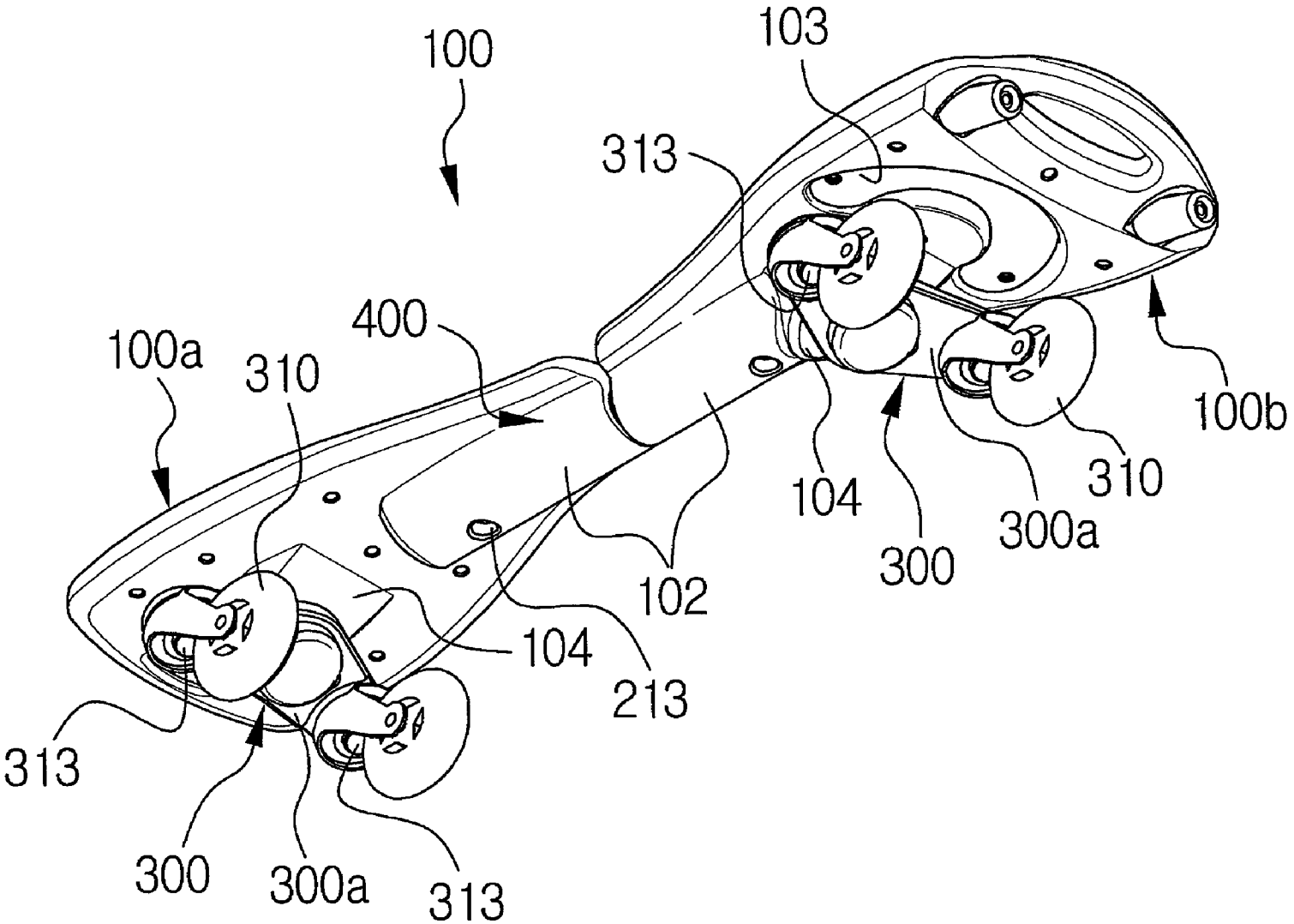

【FIG.2】
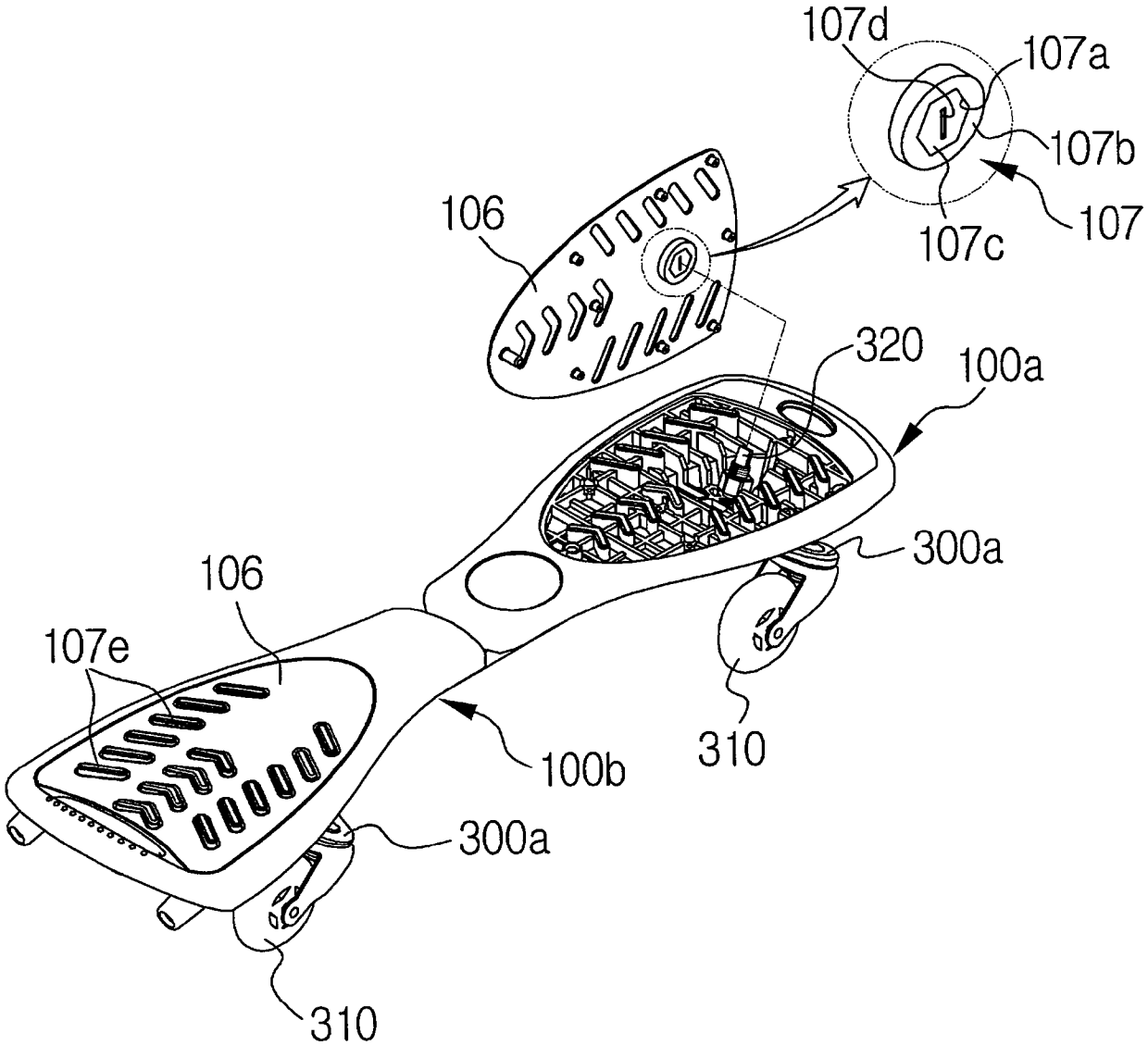

【FIG.3】
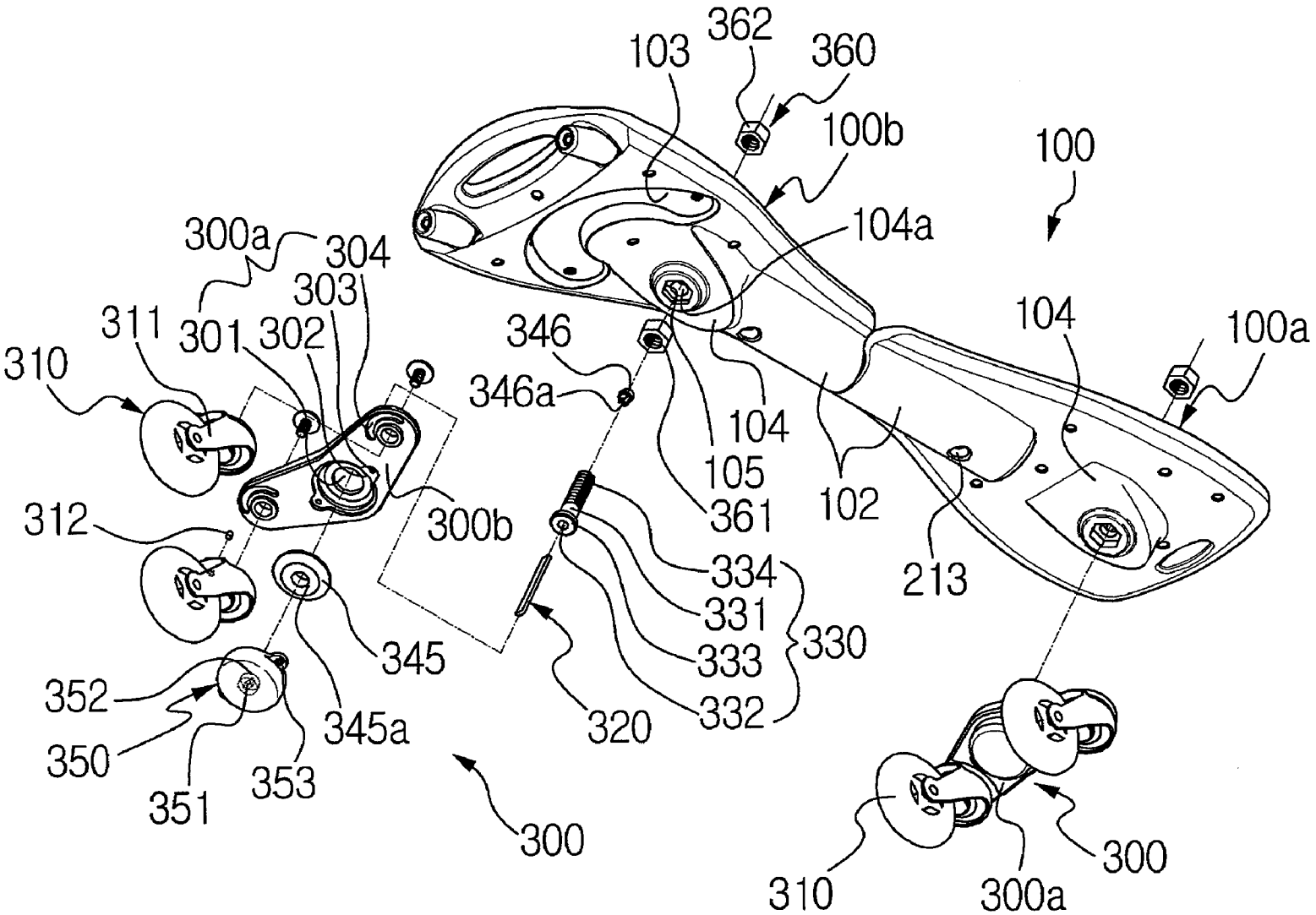

【FIG.4】
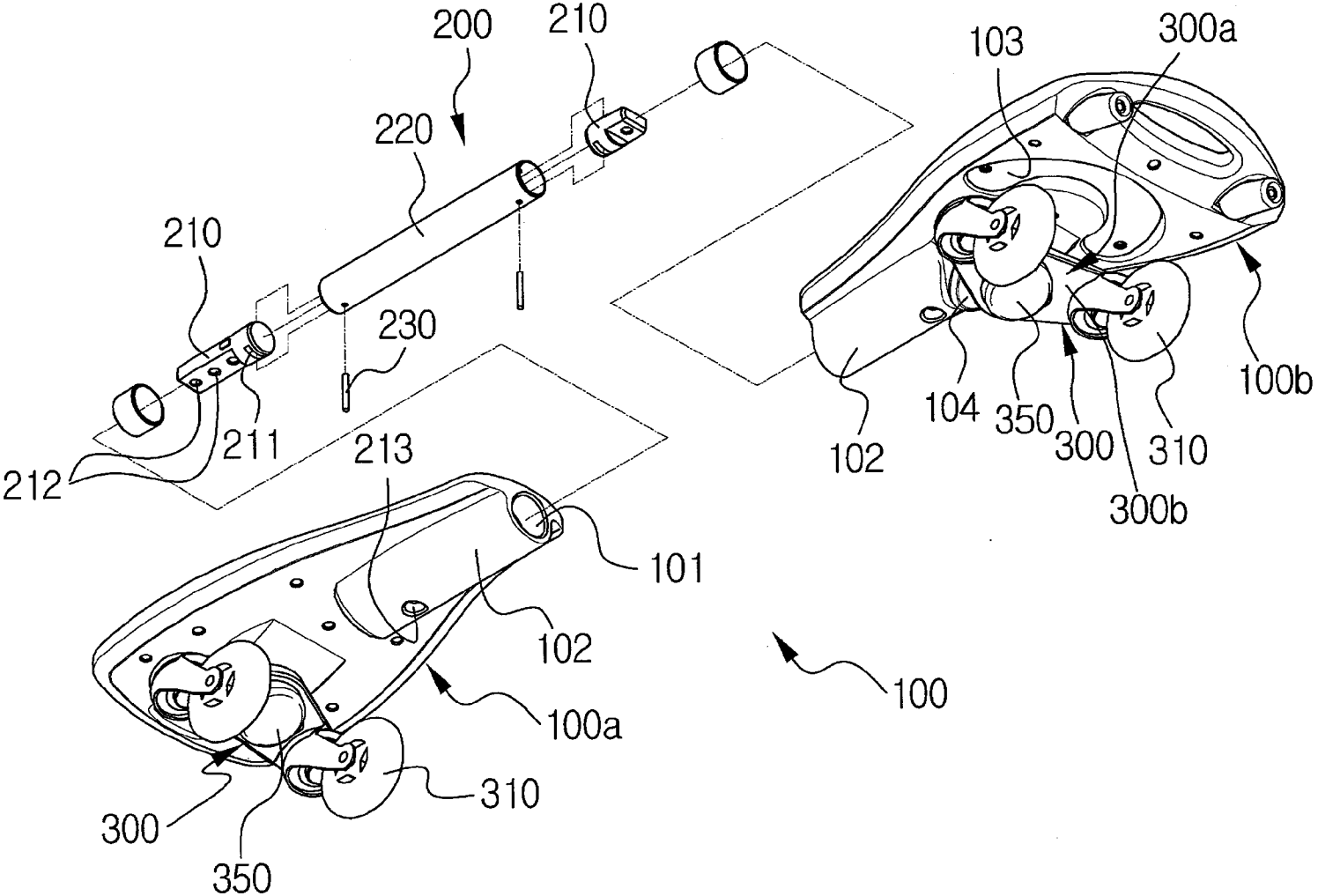

【FIG.5a】
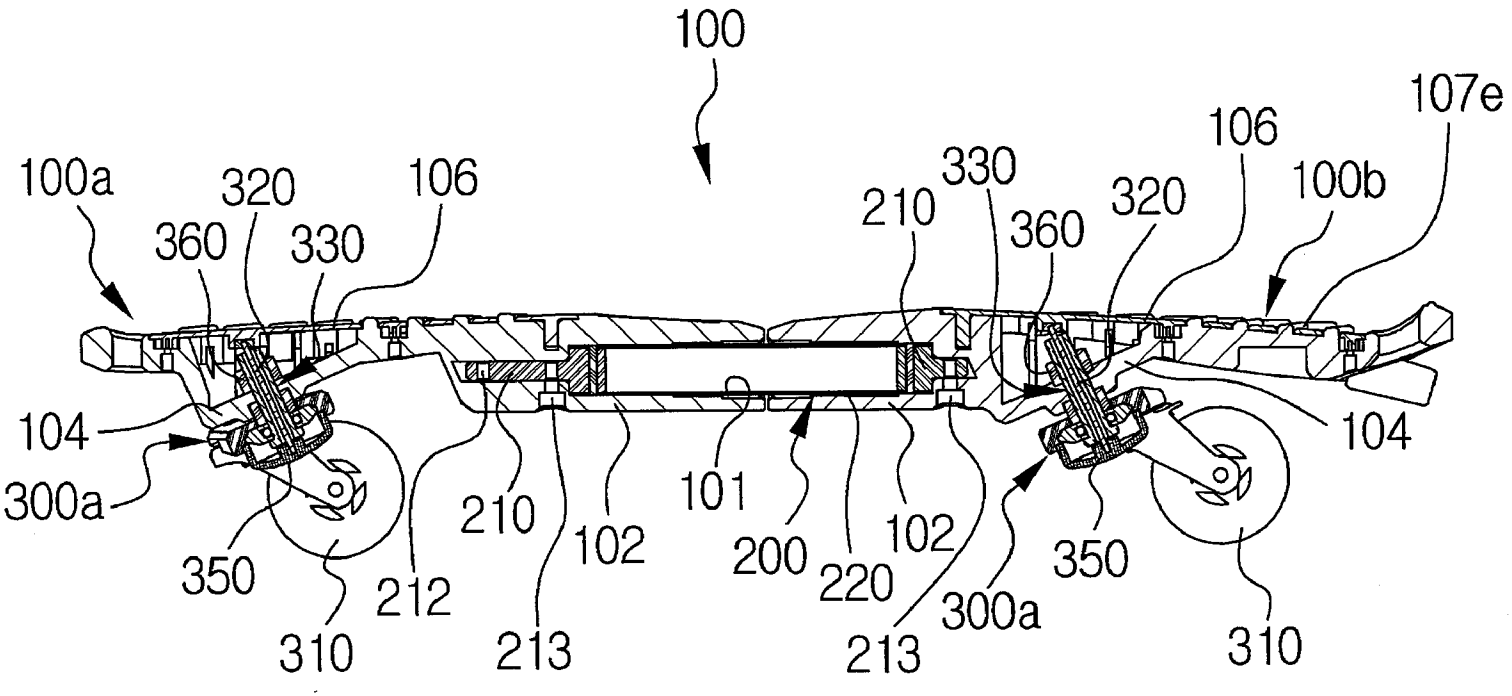

【FIG.5b】
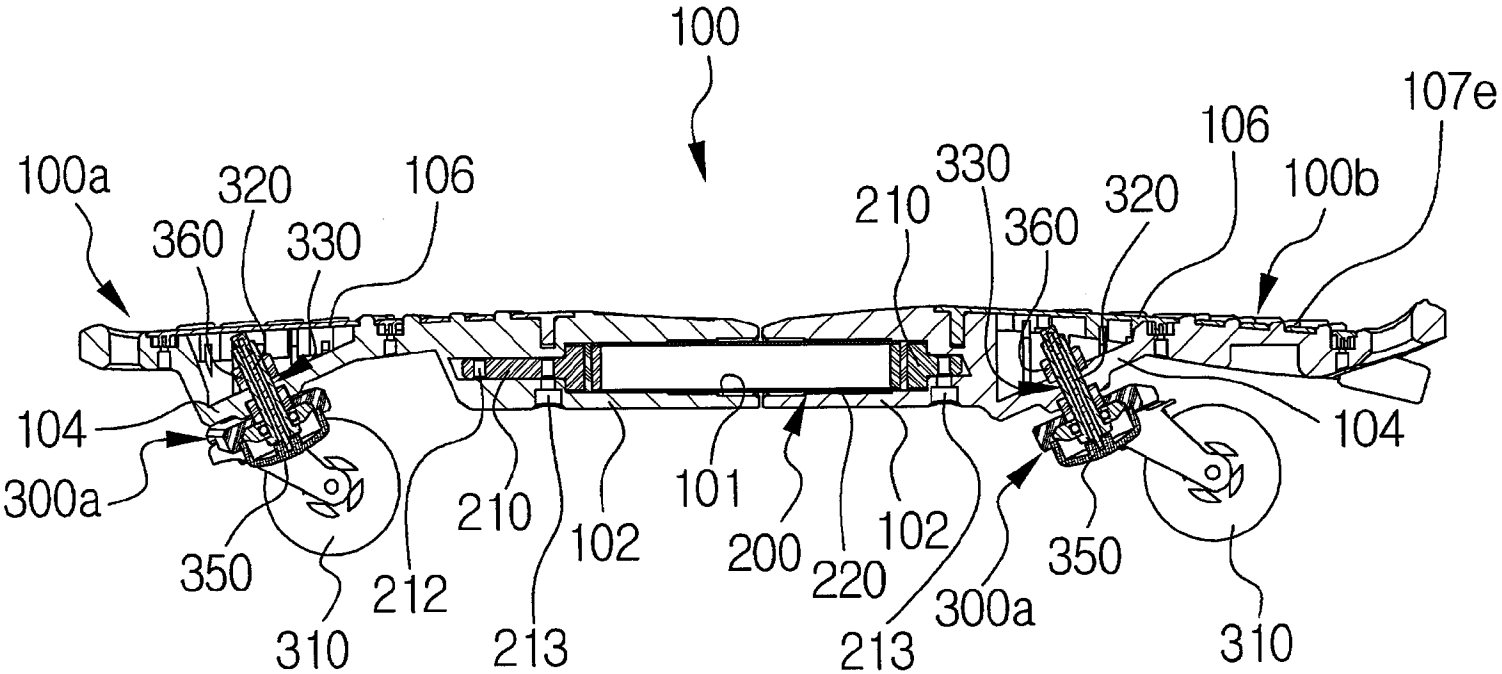

【FIG.6a】
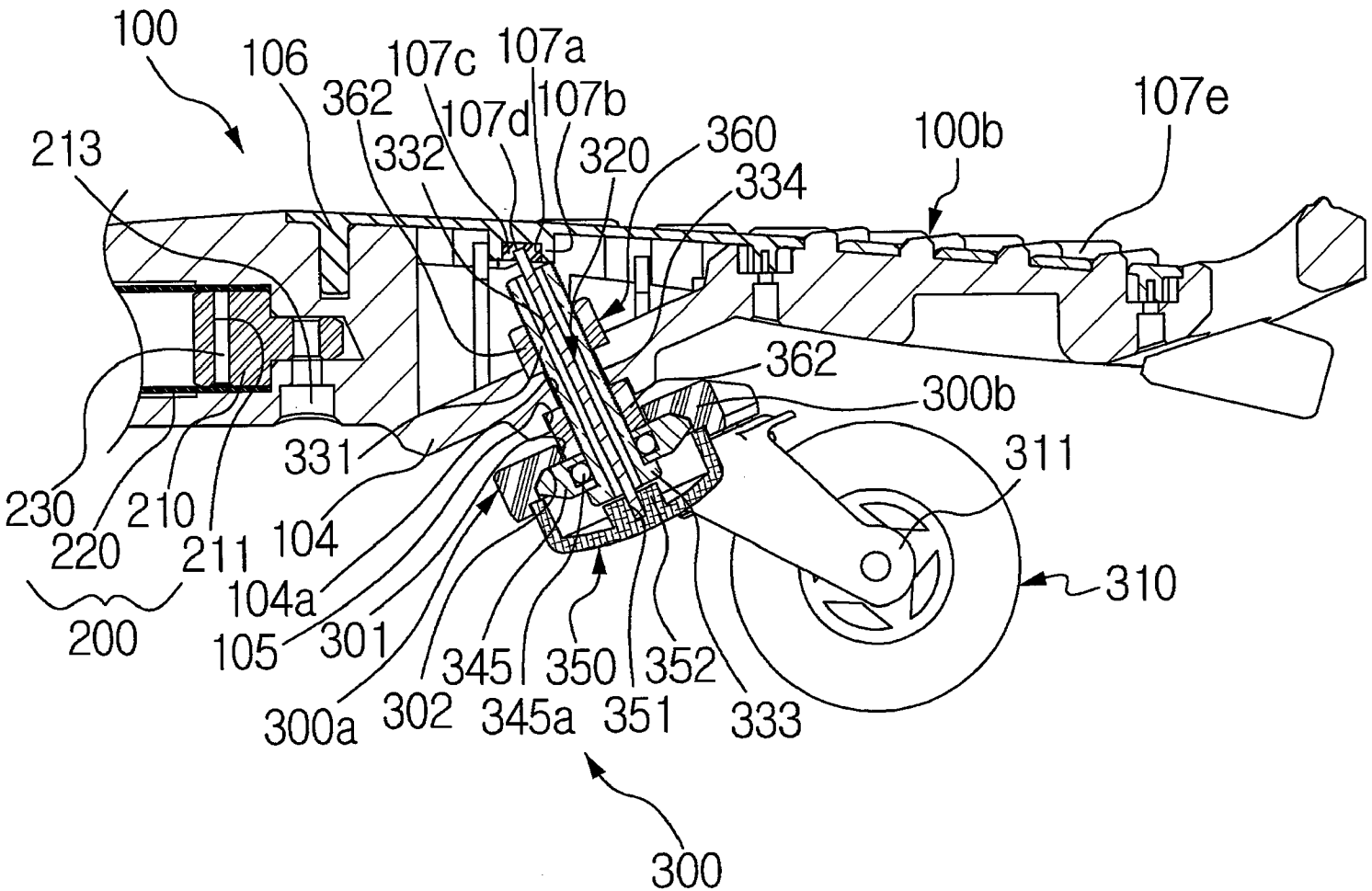

【FIG.6b】
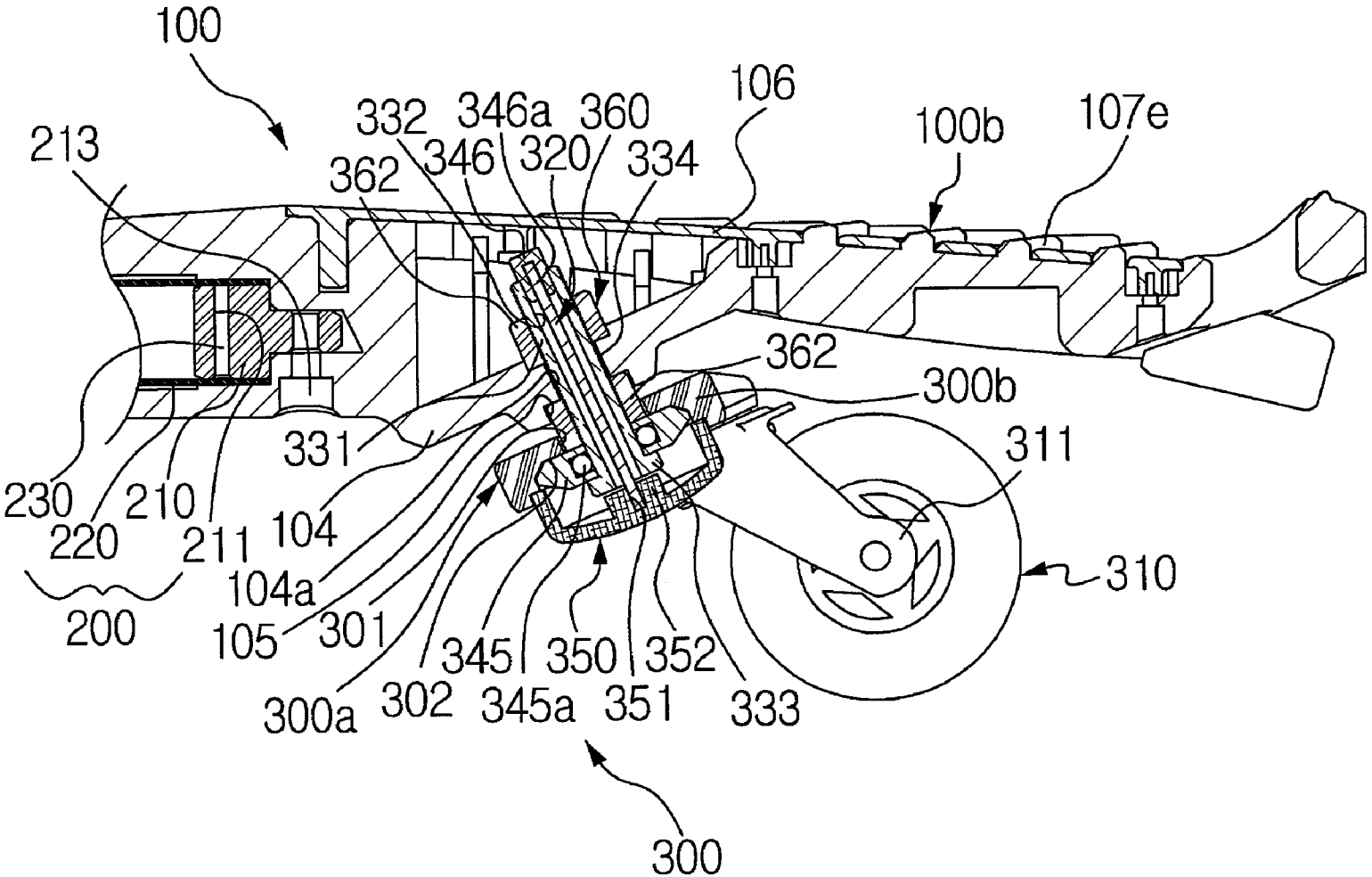

【FIG.7a】
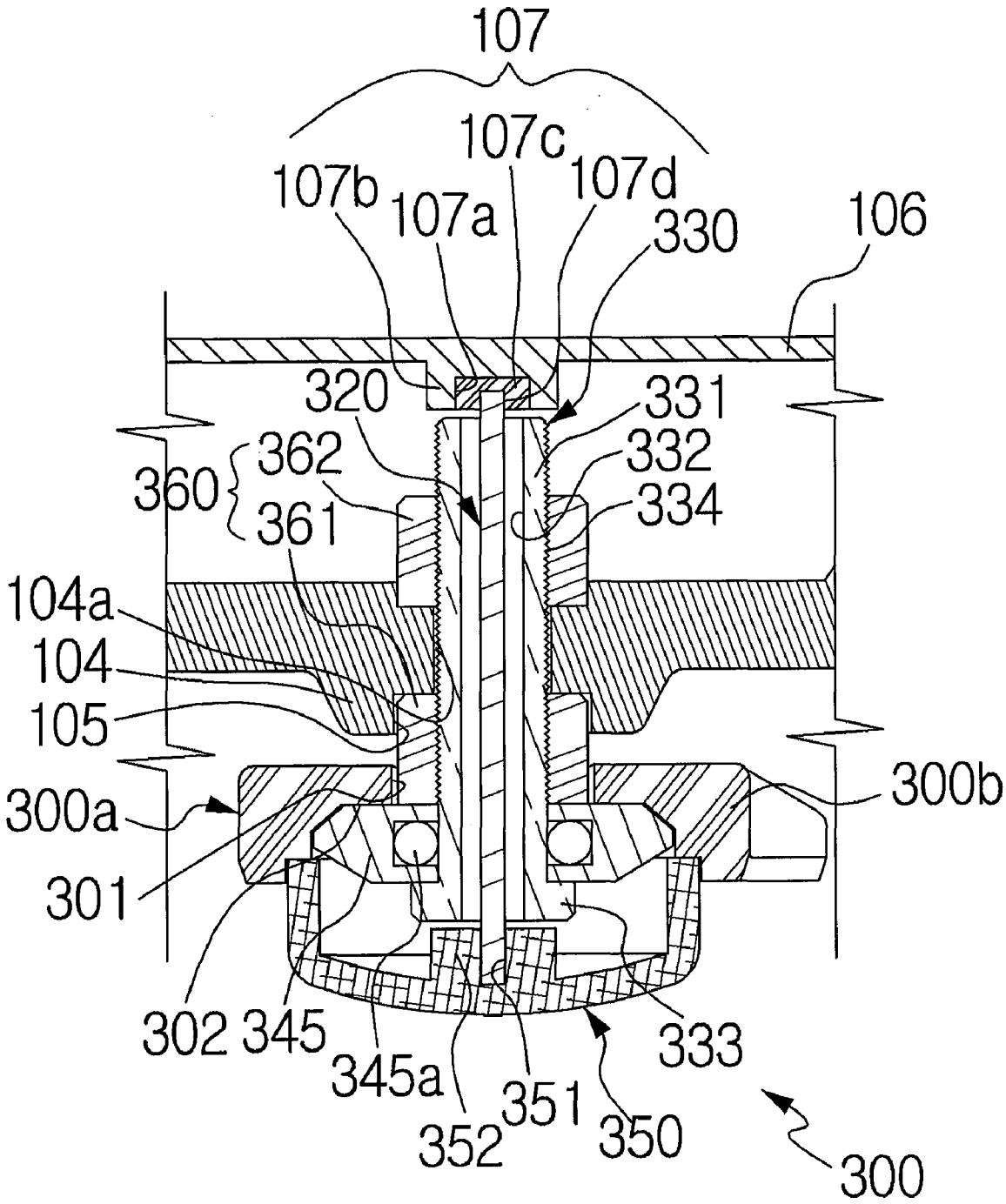

【FIG.7b】
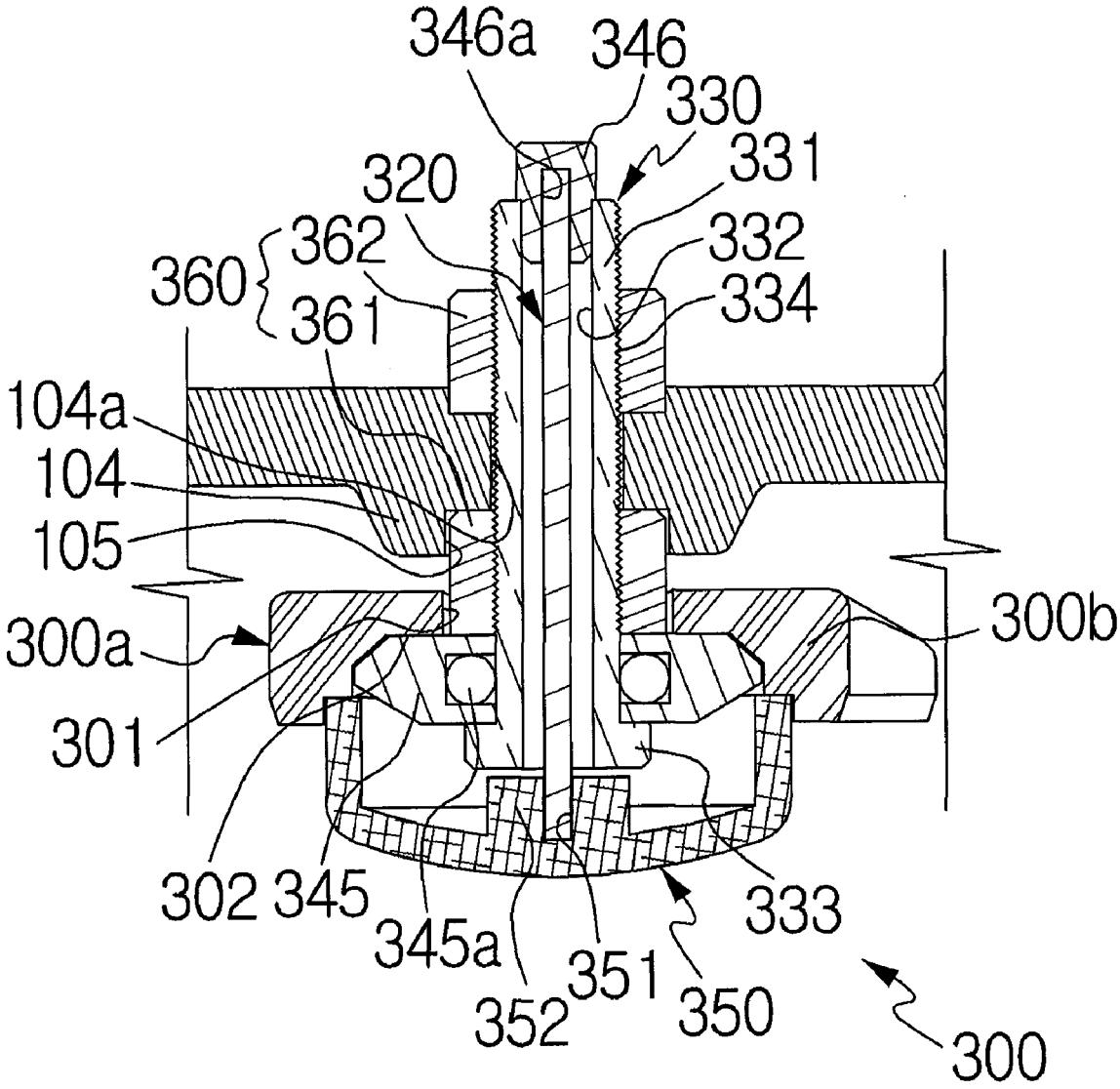

【FIG.8a】
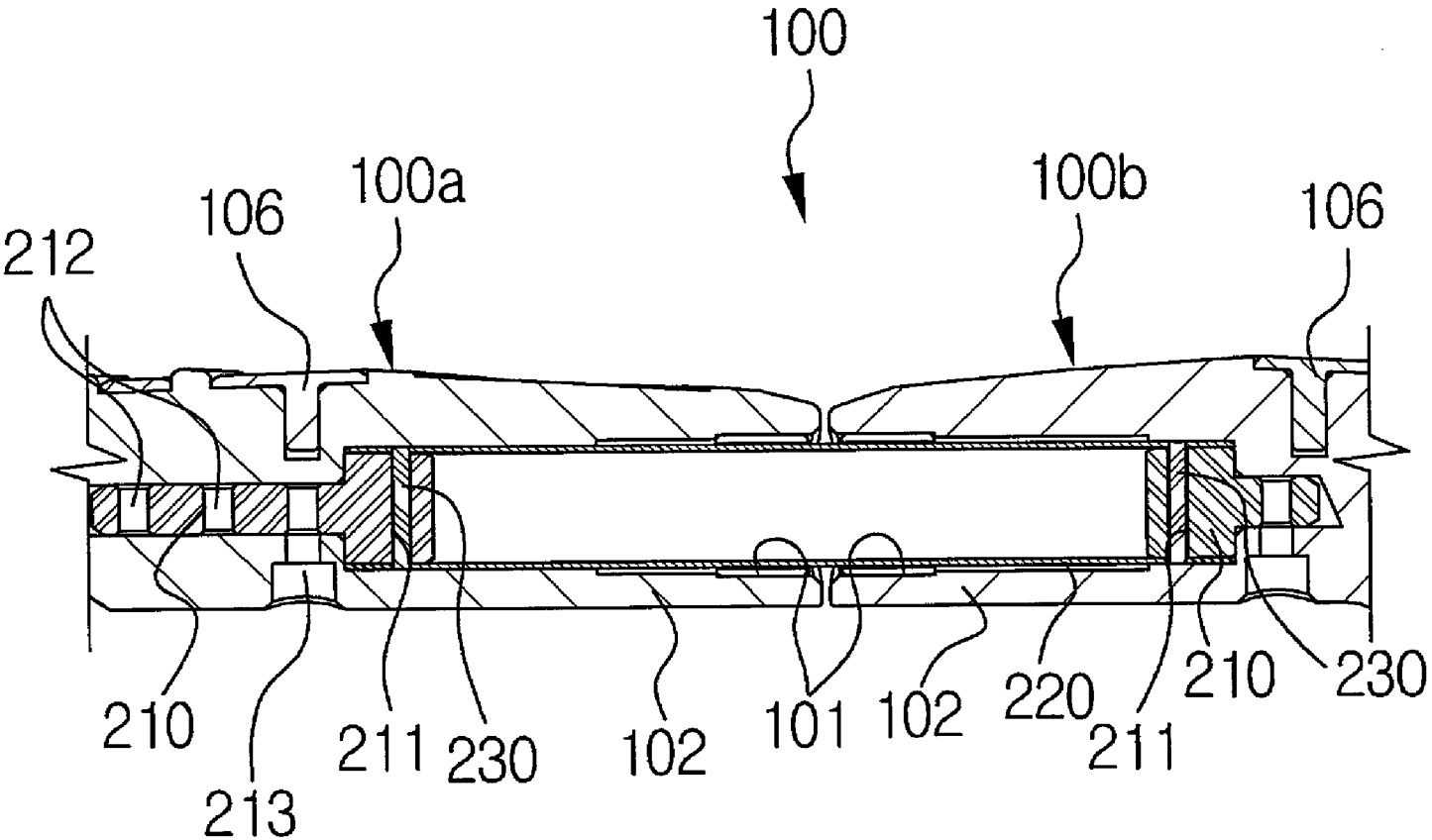

【FIG.8b】
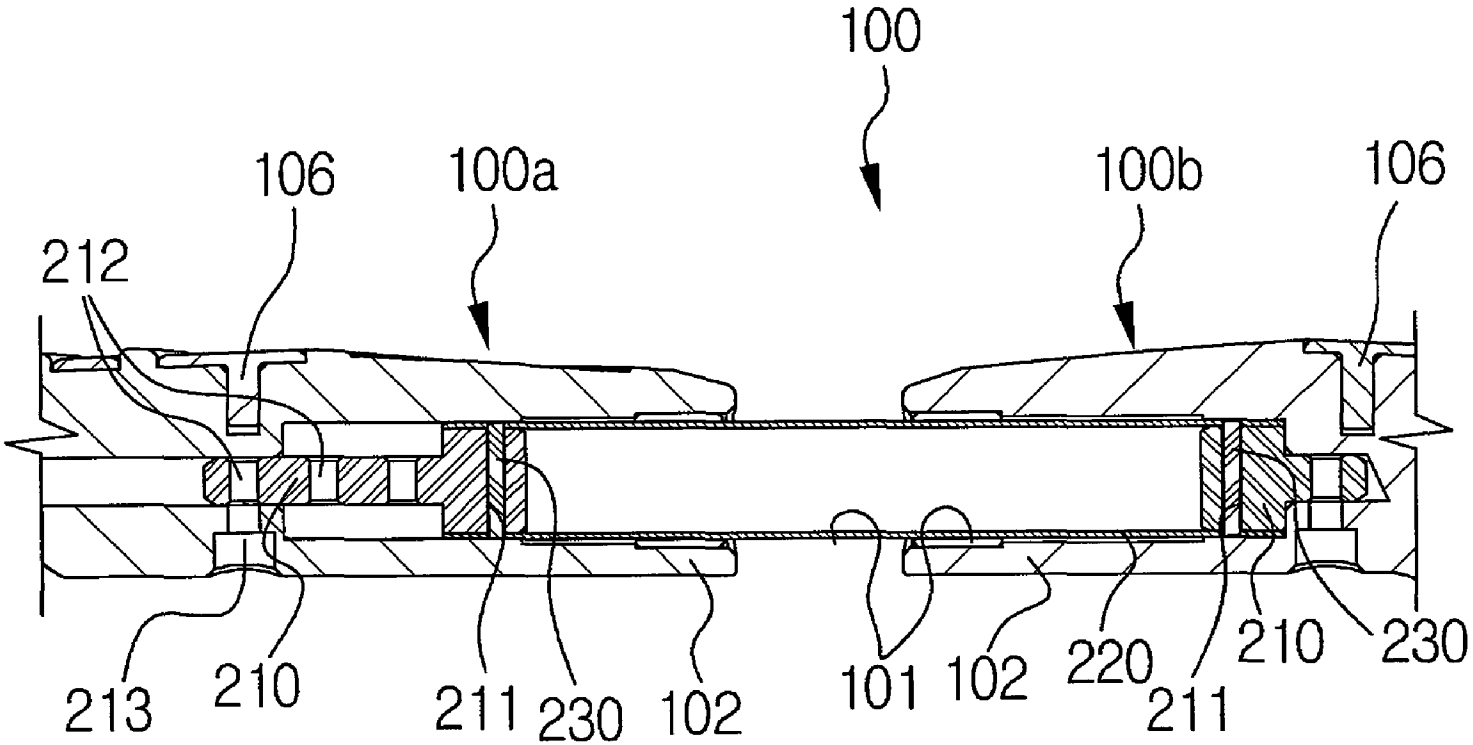

【FIG.9】
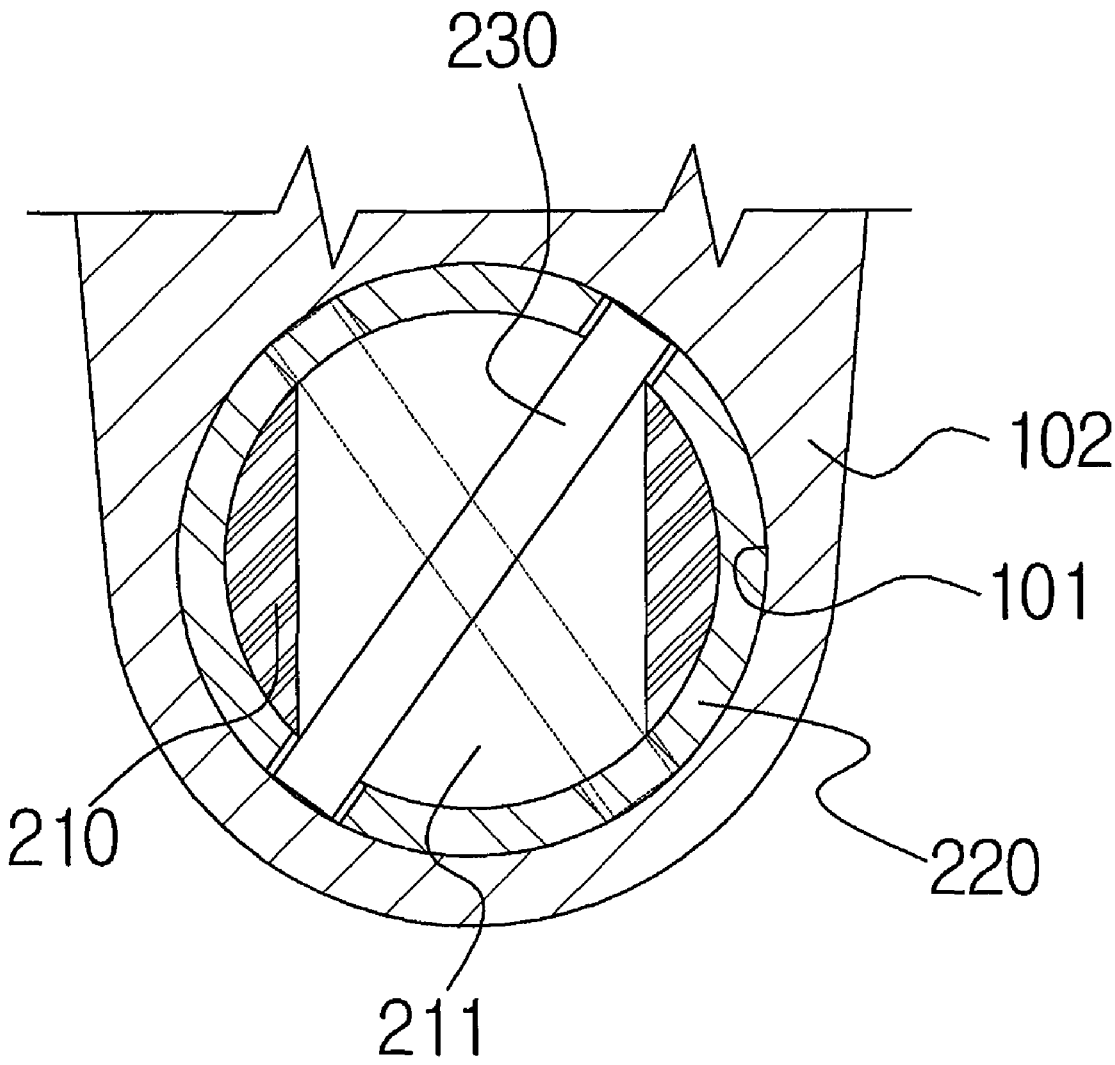

【FIG.10】
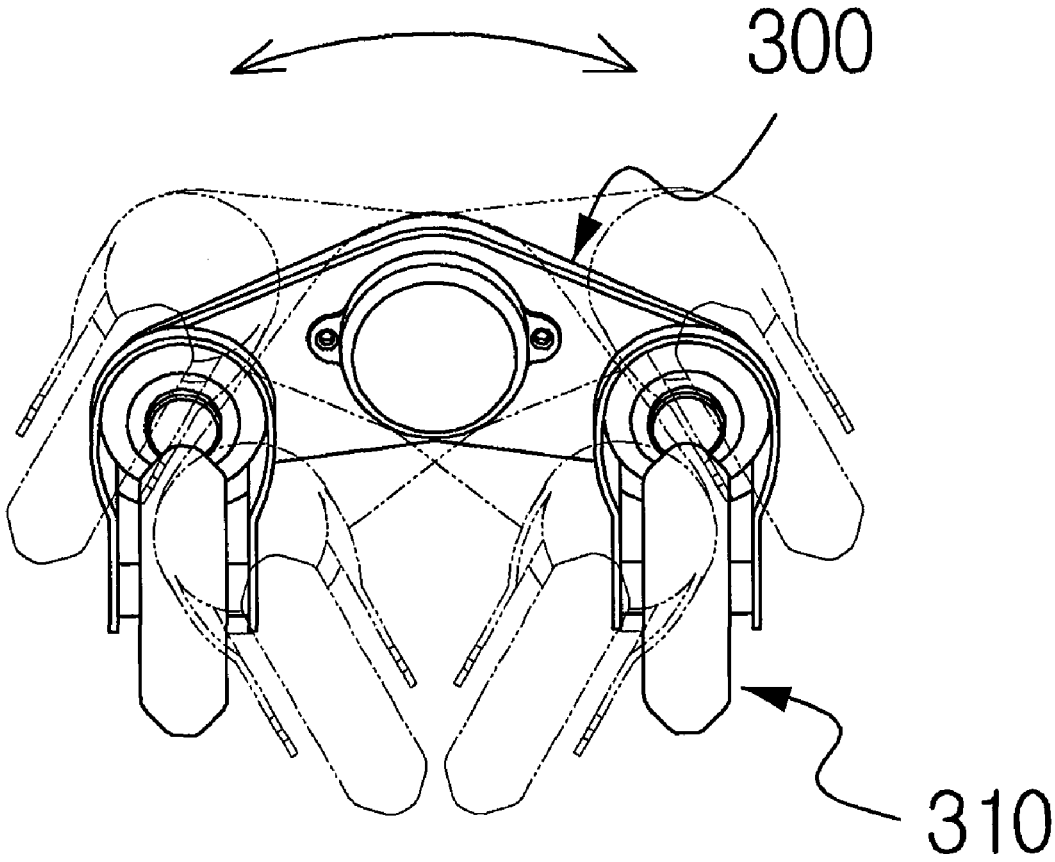

【FIG.11】
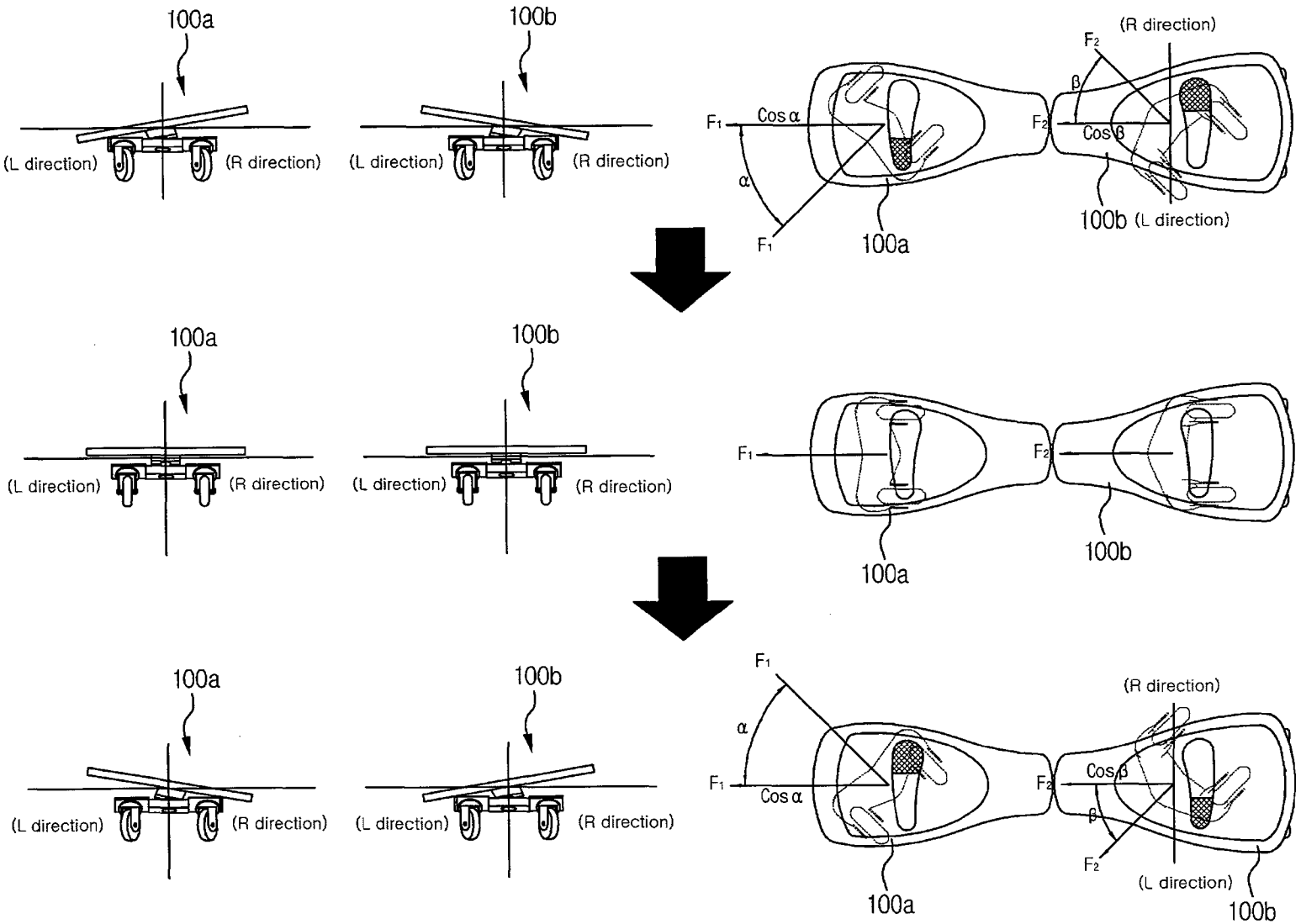

【FIG.12】
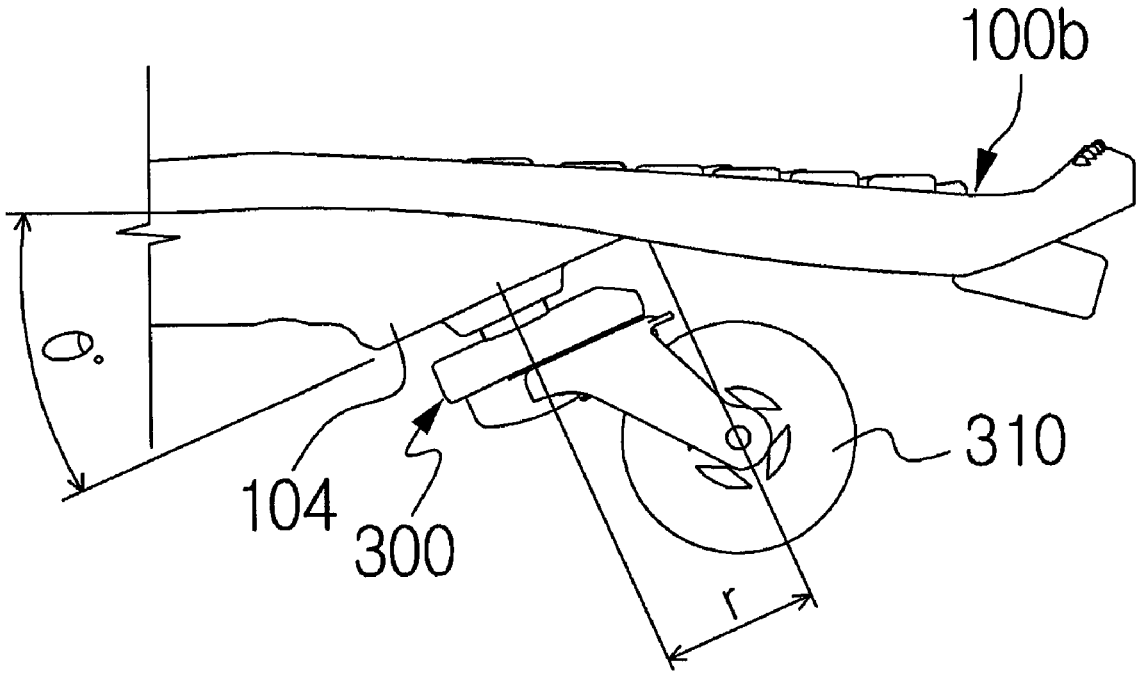

BOARD WHERE THE VOLUNTARY ADVANCE IS POSSIBLE

TECHNICAL FIELD

The present invention relates to a board that can be voluntarily moved forward by rolling (hereinafter, referred to simply as a 'voluntarily advancing board'). More specifically, the present invention relates to a voluntarily advancing board comprising a pair of boards and steering means, each of which is provided with an elastic member, coupled to the respective boards wherein the steering means accelerate the voluntary forward force of the pair of boards due to a torsional elastic force generated from the elastic members during rolling of the pair of boards to improve the forward speed and steerability of the voluntarily advancing board.

BACKGROUND ART

When a rider enjoys a conventional skateboard, he/she puts his/her one foot on the skateboard provided with wheels, stamps the ground with the other foot in the advancing direction of the skateboard to impart a propulsive force to the skateboard, places his/her both feet on the upper surface of the skateboard in an accelerated state, and alternates the positions of the front and rear feet in directions opposite to each other, so that the skateboard can be moved in a wave-like motion.

A general skateboard is configured to be advanced by the rider's stamping the ground with his/her foot to generate a propulsive force. With this configuration, an improvement in the forward force of the general skateboard is limited, resulting in a reduction of interest in the riding and mobility of the skateboard. Further, rolling casters provided at the lower sides of the skateboard cannot be independently steered, causing a degradation in the ability to steer the skateboard. This degradation poses safety hazards to the rider.

To overcome these problems, skateboards have recently been suggested in which a forward force can be generated by a repeated twisting movement without the rider's stamping the ground with his/her foot.

For example, Korean Patent Application No. 10-2002-25663 suggests a skateboard having a front board 10, a rear board 20 and a connecting element interconnecting the front and rear boards wherein at least one of the boards includes at least one direction-caster 13, 23 attached to the underside of plates 11, 21 and the connecting element includes an elastic member 65 so that the connecting element can be elastically twisted by application of at least one of a twisting or bending force and restores to its original shape when the force is removed.

When a rider alternately rolls the front board 10 and the rear board 20 through a shift of his/her center of gravity and localized distribution of force, the front board 10 and the rear board 20 are elastically rolled due to a restoring force of the elastic member 65, which is included in the connecting element of the front board 10 and the rear board 20 to provide torsional elasticity, so that the boards 10 and 20 are moved forward in a wave-like motion.

Casters 13 and 23 are mounted to the respective front board 10 and the rear board 20 of the skateboard to induce twisting of the front board 10 and the rear board 20 through the connecting element accommodating the elastic member. However, the casters mounted to the respective boards 10 and 20 make it difficult to maintain the balance of the skateboard, thus causing troublesome riding of the skateboard and requiring a long time to learn how to ride the skateboard. For these reasons, the skateboard fails to draw attention and interest of beginners.

Particularly, the elastic member 65 is not an element to directly provide a forward force to the front board 10 and the rear board 20, but indirectly assists in elastically rolling the front board 10 and the rear board 20. That is, since the elastic member 65 is not an element for generating a direct propulsive force to advance the skateboard, the skateboard is not sufficiently moved forward.

In the case where one caster 13 or 23 is mounted to the front board 10 and a pair of casters 13 and 23 are mounted to the rear board 200, safety of the boards 10 and 20 can be ensured but no twisting of the rear board 20 is induced due to a support force of the pair of casters 13 and 23 independently mounted to the rear board 13, causing a problem in that a forward force of the skateboard cannot be generated.

Particularly, when the rear board 20 is biased by excessive twisting during riding of the boards 10 and 20, the caster disposed opposite to the loaded caster of the pair of casters mounted to the rear board 20 is detached from the ground due to a seesaw effect.

That is, when a rider leans the boards 10 and 20 in one direction to advance the boards 10 and 20, his/her center of gravity is concentrated only on the casters 13, which are independently and rotatably installed under the boards 10 and 20, to cause a seesaw effect. The seesaw effect leads to detachment of the oppositely disposed caster 23 from the ground, causing a loss in the balance and equilibrium of the boards 10 and 20. As a result, the boards 10 and 20 are easily overturned, thus posing safety hazards to the rider.

To prevent the overturn of the boards 10 and 20, the rider cannot help riding the skateboard with a large turning radius. This large turning radius lowers the speed and instantaneous steerability of the skateboard.

Further, U.S. Pat. No. 4,082,306 discloses a torsion bar skateboard which comprises a front plate 10, a rear plate 11, a front assembly 12, to which a pair of wheels 17 and 18 are mounted, secured under the front plate 10, and a rear assembly 13, to which another pair of wheels 17 and 18 are mounted, secured under the rear plate 11. The pairs of wheels mounted to the respective assemblies 12 and 13 are secured such that they cannot be rotated for the purpose of steering. A tubing 27 is provided in the skateboard to interconnect the front plate 10 and the rear plate 11 and accommodates an elastic bar 30 therein.

The skateboard is configured to alternately roll the front plate 10 and the rear plate 11 to generate a forward force. The skateboard has a structure in which the assemblies 12 and 13, to which the pairs of wheels 17 and 18 are mounted, are secured under the front plate 10 and the rear plate 11, respectively, so that the pairs of wheels 17 and 18 cannot be voluntarily rotated. Although smooth rolling of the front plate 10 and the rear plate 11 can be achieved through the elastic bar 30 during advance of the skateboard, the wheels 17 and 18 cannot be steered along an advancing direction of the skateboard in a wave-like motion by rolling.

As a result, the steerability of the skateboard is degraded and the rolling forward force of the skateboard is reduced.

As mentioned above, the elastic bar 30 is a constituent element for indirectly supporting the rolling movement of the front plate 10 and the rear plate 11. Since the elastic bar 30 is not an element to directly generate a forward force of the skateboard, the wheels 17 and 18 having no steerability further decrease the forward force of the skateboard and degrade the instantaneous steerability of the skateboard.

Further, U.S. Patent Publication No. 2002-195788 discloses a steerable in-line street ski comprising a plate 11 and a plurality of self-steerable wheels 12 and 13 mounted to both lower sides of the plate 11.

Rotating bodies 15 and 16 capable of rotating at 360° are provided at lower sides of the plate 11 so that the wheels are freely steered along the rolling direction of the plate 1. However, since the front wheel 12 and the rear wheel 13 are integrated with the plate 11, the wheels 12 and 13 are steered in the same direction, depending on the rolling direction of the plate 1. This steering of the wheels 12 and 13 in the same direction weakens the forward force of the in-line street ski and increases the turning radius of the in-line street ski, causing a degradation in instantaneous steerability.

Further, Korean Patent Application No. 10-2005-48075 discloses a roller board which comprises a front board, a rear board disposed at a certain distance apart from the front board, a connecting body for interconnecting the front and rear boards, fixing frames fixed to lower portions of the respective front and rear boards, arms 320*a* and 320*b* for supporting respective rollers 330*a* and 330*b*, bolts and nuts for rotatably connecting the arms to the frames, and a brake unit for controlling the rotation of the rollers to generate a braking power. The brake unit has an elongated hole formed at the arms, a brake shaft moved up and down along the hole, and a pressing unit for pressurizing the rollers through the brake shaft.

In the roller board, the front and rear boards are connected to the respective rollers 330*a* and 330*b* through the arms 320*a* and 320*b* rotatably coupled to lower sides of the front and rear board, and the rollers are mounted to the arms 320*a* and 320*b* where the rollers are only allowed to be rolled. As a result, the roller board has a considerably large turning radius when cornering.

In case of emergencies during riding, this large turning radius makes quick turning of the roller board difficult without decreasing the speed, resulting in an increased danger of accidents.

Rolling operation is effected by the pair of arms 320*a* and 320*b* rotatably coupled to lower sides of the front and rear boards and torsional springs 220*a* and 222*a*, and bending operation in left and right directions is effected by a pair of horizontal springs 260*a* and 260*b*. A combination of the rolling operation and the bending operation contributes to a forward movement of the roller board. However, since simultaneous realization of the rolling and bending operations in a state in which both feet of a rider are placed on the respective boards is substantially difficult, the rider can hardly keep his/her balance on the roller board, which makes it difficult for a beginner to learn how to ride the roller board.

That is, when bending in left and right directions and rolling are effected to generate a forward force of the roller board, it is difficult for a user to maintain component forces of parallelism in the roller board, resulting in increased occurrence of minor and fatal accidents during riding.

DISCLOSURE

Technical Problem

Therefore, it is a principal object of the present invention to provide a board, that can be voluntarily moved forward by rolling, comprising a pair of steering means, each of which is provided with an elastic member, that are elastically restorable in the advancing direction of the board to accelerate the voluntary forward force of casters, thereby improving the forward speed and steering performance of the board.

It is another object of the present invention to provide a voluntarily advancing board comprising a pair of boards that are rotatable within respective limited angle ranges, steering means, that are restorable to their original position, coupled to the respective boards, and freely rotatable casters mounted to the respective steering means so that repetitive rolling movement can be elastically effected when the pair of boards are alternately rolled, thereby enhancing the forward force of the voluntarily advancing board.

It is another object of the present invention to provide a voluntarily advancing board comprising a pair of boards, steering means and caster means wherein the steering means and the caster means are allowed to be freely rotated in multiple directions so that the voluntarily advancing board can be quickly turned and rotated at 360° with a small turning radius in its place, thereby ensuring smooth and stable riding of the voluntarily advancing board even when cornering.

It is another object of the present invention to provide a voluntarily advancing board comprising a pair of steering means, each of which has angle-adjusting grooves formed therein, and a pair of directional casters, each of which is provided with a stopper guided by the corresponding angle-adjusting groove to limit the steering angle range of the pair of directional casters, so that more stable riding of the voluntarily advancing board can be guaranteed.

It is another object of the present invention to provide a voluntarily advancing board comprising a front board, a rear board, and steering means, each of which has a pair of casters, coupled to the respective front and rear boards to always maintain the adhesive force to the ground and the horizontal state of the voluntarily advancing board so that a beginner can easily learn how to ride the voluntarily advancing board, thereby achieving popularization of the voluntarily advancing board and maximizing the safety of the voluntarily advancing board.

It is yet another object of the present invention to provide a voluntarily advancing board comprising a front board, a rear board, and a connecting assembly, which includes a connecting pipe, fixing blocks fitted into the connecting pipe and a plurality of length-adjusting holes formed at regular intervals in each of the fixing blocks, wherein each of the front and rear boards is secured to the connecting assembly by means of a fastening member through one hole selected from the length-adjusting holes so that the distance between the pair of front and rear boards can be optionally controlled to adjust the size of the voluntarily advancing board to physical conditions of a user.

Technical Solution

The present invention provides a directional voluntarily advancing board, comprising:

a pair of front and rear boards, each of which is integrated with a connecting step formed on its lower surface and includes a connecting hole formed within the connecting step, a slope formed protrudedly at a lateral side of the connecting step and a slide-preventing cover attached to its upper surface, the connecting holes being communicated with each other;

a connecting assembly including a connecting pipe inserted into the connecting holes, fixing blocks rotatably coupled to both ends of the connecting pipe to integrally connect the front board and the rear board, each of the fixing blocks having a track groove, and coupling pins inserted into the track grooves through the connecting pipe to be in association with the connecting pipe so that the front and rear boards are rotated within limited angle ranges corresponding to predetermined widths of the track grooves; and voluntary advancement assemblies, each of which includes a steering means having a steering block and rotatably mounted to the slope formed at a lower side of the corresponding board so as to be inclined toward the rear of the pair of boards, a main steering shaft provided with an elastic member and coupled to the steering block, both ends of the elastic member being fixed to the corresponding board and the steering means, respectively, and a pair of caster means, which are installed to face each other at both sides of the steering means, capable of being steered and rolled by means of bearings provided at both sides of the steering means so that a twisting force of the elastic member generated from rolling of the pair of boards allows the pairs of caster means to be elastically moved forward in an alternating manner while the pairs of caster means are disaligned.

In an embodiment of the present invention, the steering means is configured to include: an elastic member; a steering block having a coupling hole formed at its center, a coupling groove in a multiple step shape formed at an end portion of the coupling hole to be communicated with the coupling hole, and a rotation-preventing recess partially protruded from an inner circumference of the coupling groove toward the outside of the coupling groove; a main steering shaft for accommodating the elastic member in a perpendicular downward position so as to allow upper and lower portions of the elastic member to be partially exposed to the outside; a twist cover coupled with the lower portion of the elastic member exposed to the outside and fixed to the coupling groove of the steering block; and a fixing means for securing the main steering shaft to the corresponding board through the slope.

In a further embodiment of the present invention, the main steering shaft is configured to include: a fixing shaft having a fixing hole formed at its center so as to accommodate the elastic member therein, a flange formed at an upper portion of its outer circumference, and a male thread formed at a lower portion of its outer circumference; and a support block coupled to the outer circumference of the fixing shaft so as to be attached to the lower end of the flange and provided with a bearing so as to be smoothly rotated about the fixing shaft.

In another embodiment of the present invention, the slide-preventing cover is configured to include a plurality of projections exposed to the outside through the corresponding board and a rotation-preventing means formed on a lower surface of the slide-preventing cover to fix the upper portion of the elastic member wherein the rotation-preventing means has a protruded block formed on a lower surface of the slide-preventing cover, an introduction recess formed in the protruded block, an insertion block fitted into the protruded block and an insertion slot formed in the insertion block to insert the upper portion of the elastic member thereinto.

In another embodiment of the present invention, the rotation-preventing means is configured to insert a rotation-preventing block into the fixing hole formed at an upper end of the fixing shaft so that the upper portion of the elastic member partially exposed to the outside from the upper end of the fixing shaft is inserted into an insertion slot formed at a lower end of the rotation-preventing block.

In another embodiment of the present invention, the twist cover is in the form of a cover having an open bottom, and is configured to include: a fixing protrusion; an insertion slot formed at the center of the inner surface of the fixing protrusion to insert the elastic member partially exposed from the lower portion of the main steering shaft thereinto; a rotation-preventing protrusion formed on an outer circumference of the twist cover to be fitted into the rotation-preventing recess of the steering block; and a fastening member for fixing the rotation-preventing protrusion to the rotation-preventing recess.

In another embodiment of the present invention, the fixing means is configured to include: a polygonal fixing member engaged with the male thread of the main steering shaft to integrally fix the support block to the main steering shaft and to position the support block at an entrance end of a fixing hole formed in the slope of the corresponding board, and fitted into a fixing protrusion having the same polygonal shape as the fixing member; and a fastening member engaged with the male thread of the main steering shaft through the fixing hole to integrally fix the main steering shaft coupled with the steering means to the slope of the corresponding board.

In another embodiment of the present invention, the steering block of the steering means allowing rotation of the pair of caster means is configured to have fixing holes and angle-adjusting grooves, each of which has the same center of curvature as the corresponding fixing hole, formed at lateral sides of the respective fixing holes; and each of the pair of caster means is provided with a bracket inserted into the corresponding fixing hole and a stopper projected from an upper end of the bracket to be introduced into the corresponding angle-adjusting groove so that the rotational angle of the caster means rotatably mounted to the steering means can be limited.

In another embodiment of the present invention, the rear board is configured to include an interference-preventing groove formed on a lower surface of the rear board to prevent both end portions of the steering means, which is mounted to the slope and is rotated within a particular angle range, from interfering with each other wherein the interference-preventing groove has an arc shape identical to the track of the rotational movement of the steering means.

In still another embodiment of the present invention, each of the fixing blocks of the connecting assembly is configured to include a plurality of length-adjusting holes perpendicularly formed at regular intervals in front of the corresponding track groove wherein the corresponding board is secured to the connecting assembly by means of a fastening member through one hole selected from the length-adjusting holes so that the distance between the pair of front and rear boards can be optionally controlled.

ADVANTAGEOUS EFFECTS

According to the voluntarily advancing board of the present invention, a pair of steering means, each of which is provided with a spring, that are elastically restorable in the advancing direction of the voluntarily advancing board during rolling are installed to accelerate the voluntary forward force of casters, thereby improving the forward speed and steering performance of the voluntarily advancing board.

Further, a pair of boards that are rotatable within respective limited angle ranges, steering means, that are restorable to their original position, coupled to the respective boards, and freely rotatable casters mounted to the respective steering means are provided in the voluntarily advancing board of the present invention, so that repetitive rolling movement can be elastically effected when the pair of boards are alternately rolled, thereby further improving the forward force of the voluntarily advancing board.

Further, according to the voluntarily advancing board of the present invention, steering means and caster means are mounted to a pair of boards to allow the steering means and the caster means to be freely rotated in multiple directions.

With this configuration, the voluntarily advancing board of the present invention can be quickly turned and rotated at 360° with a small turning radius in its place, thereby ensuring smooth and stable riding of the voluntarily advancing board even when cornering.

Further, according to the voluntarily advancing board of the present invention, since the steering angle range of a pair of directional casters is limited, more stable riding of the voluntarily advancing board can be guaranteed.

Furthermore, steering means, each of which has a pair of casters, are coupled to a front board and a rear board to always maintain the adhesive force to the ground and the horizontal state of the voluntarily advancing board so that a beginner can easily learn how to ride the voluntarily advancing board, thereby achieving popularization of the voluntarily advancing board and maximizing the safety of the voluntarily advancing board.

Moreover, according to the voluntarily advancing board of the present invention, a connecting assembly, which includes a connecting pipe, fixing blocks fitted into the connecting pipe and a plurality of length-adjusting holes formed at regular intervals in each of the fixing blocks, are provided to interconnect a front board and a rear board. The front and rear boards are secured to the connecting assembly by means of a fastening member through one hole selected from the length-adjusting holes so that the distance between the pair of front and rear boards can be optionally controlled to adjust the size of the voluntarily advancing board to physical conditions of a user.

DESCRIPTION OF DRAWINGS

The above and other objects, features and other advantages of the present invention will be more clearly understood from the following detailed description taken in conjunction with the accompanying drawings, in which:

FIG. 1 is a bottom perspective view of a voluntarily advancing board according to the present invention;

FIG. 2 is an exploded perspective view of a voluntarily advancing board according to the present invention;

FIG. 3 is a bottom exploded perspective view of a voluntarily advancing board according to the present invention;

FIG. 4 is a bottom exploded perspective view showing a connecting assembly of a voluntarily advancing board according to the present invention;

FIG. 5*a* is a side sectional view of a voluntarily advancing board according to the present invention, and FIG. 5*b* is a side sectional view of a voluntarily advancing board according to another embodiment of the present invention;

FIG. 6*a* is an enlarged sectional view of a voluntarily advancing board according to the present invention, and FIG. 6*b* is an enlarged sectional view of a voluntarily advancing board according to another embodiment of the present invention;

FIG. 7*a* is a fragmentary enlarged sectional view showing a voluntary advancement assembly of a voluntarily advancing board according to the present invention, and FIG. 7*b* is a fragmentary enlarged sectional view showing a voluntary advancement assembly of a voluntarily advancing board according to another embodiment of the present invention;

FIGS. 8*a* and 8*b* are cross-sectional views illustrating the operational states of a connecting assembly of a voluntarily advancing board according to the present invention;

FIG. 9 is a longitudinal sectional view showing a connecting assembly of a voluntarily advancing board according to the present invention;

FIG. 10 illustrates the operational state of a voluntary advancement assembly of a voluntarily advancing board according to the present invention;

FIG. 11 sequentially illustrates the advancing stages of a voluntarily advancing board according to the present invention; and FIG. 12 is an enlarged side view of a voluntarily advancing board according to the present invention.

BEST MODE

Preferred embodiments of the present invention will now be described in detail with reference to the accompanying drawings. It should be noted that, wherever possible, the same reference numerals represent the same elements or parts throughout the drawings. For the purpose of clarity, a detailed description of known functions and configurations incorporated herein will be omitted as they may make the subject matter of the present invention unclear.

FIG. 1 is a bottom perspective view of a voluntarily advancing board according to the present invention; FIG. 2 is an exploded perspective view of a voluntarily advancing board according to the present invention; FIG. 3 is a bottom exploded perspective view of a voluntarily advancing board according to the present invention; FIG. 4 is a bottom exploded perspective view showing a connecting assembly of a voluntarily advancing board according to the present invention; FIG. 5*a* is a side sectional view of a voluntarily advancing board according to the present invention, and FIG. 5*b* is a side sectional view of a voluntarily advancing board according to another embodiment of the present invention; FIG. 6*a* is an enlarged sectional view of a voluntarily advancing board according to the present invention, and FIG. 6*b* is an enlarged sectional view of a voluntarily advancing board according to another embodiment of the present invention; FIG. 7*a* is a fragmentary enlarged sectional view showing a voluntary advancement assembly of a voluntarily advancing board according to the present invention, and FIG. 7*b* is a fragmentary enlarged sectional view showing a voluntary advancement assembly of a voluntarily advancing board according to another embodiment of the present invention; FIGS. 8*a* and 8*b* are cross-sectional views illustrating the operational states of a connecting assembly of a voluntarily advancing board according to the present invention; FIG. 9 is a longitudinal sectional view showing a connecting assembly of a voluntarily advancing board according to the present invention; FIG. 10 illustrates the operational state of a voluntary advancement assembly of a voluntarily advancing board according to the present invention; FIG. 11 sequentially illustrates the advancing stages of a voluntarily advancing board according to the present invention; and FIG. 12 is an enlarged side view of a voluntarily advancing board according to the present invention.

First, as shown in FIGS. 1 through 12, the voluntarily advancing board of the present invention comprises a pair of front and rear boards 100*a* and 100*b*, a connecting assembly 200 for connecting the front board 100*a* to the rear board 100*b* to allow the pair of front and rear boards to be rotated within respective limited angle ranges, and voluntary advancement assemblies 300, each of which includes a pair of caster means 310, coupled to the lower sides of the respective front and rear boards 100*a* and 100*b* to repeatedly rotate the pairs of caster means 310 due to a torsional elastic force generated during rolling of the pair of boards so that the pair of boards can be moved forward.

Connecting steps 102 are formed on the lower surfaces of the respective front and rear boards, and connecting holes 101 are formed within the respective connecting steps such that the connecting holes are communicated with each other.

Slopes 104 are formed protrudedly at the lateral sides of the connecting steps 102 and are formed so as to be inclined toward the rear of the pair of boards. Slide-preventing covers are attached to the upper surfaces of the respective front and rear boards.

As shown in FIGS. 4, 8*a* and 8*b*, the connecting assembly 200 is mounted in the connecting holes to integrally connect the front board 100*a* and the rear board 100*b* and is configured such that the front and rear boards 100*a* and 100*b* are freely rotated within respective limited angle ranges.

That is, fixing blocks 210 are inserted within the respective connecting holes 101. Each of the fixing blocks 210 is fixed to the corresponding board 100*a* or 100*b* by means of a fastening member 213. The fixing blocks 210 are connected to each other through a hollow connecting pipe 220.

At this time, coupling pins 230 penetrate the end portions of the connecting pipe 220 and are inserted into track grooves 211 having predetermined widths formed in the respective fixing blocks so that the coupling pins 230 can travel within the width of the track grooves, which enables rotation of the coupling pins 230 at particular angles in the connecting pipe 220. Therefore, when the front board 100*a* and the rear board 100*b* are alternately rolled, the coupling pins 230 are rotated within respective limited angle ranges corresponding to the width of the track grooves 211 to limit the rolling angles of the front and rear boards 100*a* and 100*b* integrally connected to the respective fixing blocks 210.

Generally, the rolling angles of the front board 100*a* and the rear board 100*b* enable rotation at a limited angle of 45° in one of the track grooves 211. Therefore, the rolling rotational angle of the pair of boards 100*a* and 100*b* is restricted to a maximum of 90°.

In addition, a plurality of length-adjusting holes 212 are formed at the same interval in the front direction of the corresponding track groove 211 in each of the fixing blocks 210 of the connecting assembly 200. Each of the fastening members 213 is fixed to the corresponding board 100*a* or 100*b* through one hole selected from the length-adjusting holes 212 so that the distance between the pair of front and rear boards 100*a* and 100*b* can be optionally controlled to adjust the size of the voluntarily advancing board to physical conditions of a user.

Each of the voluntary advancement assemblies 300 includes a steering means 300*a* having a steering block 300*b* and rotatably mounted to the slope 104 formed at the lower side of the corresponding board 100*a* or 100*b* so as to be inclined toward the rear of the pair of boards 100*a* and 100*b*, a main steering shaft 330 provided with an elastic member 320 and coupled to the steering block 300*b*, both ends of the elastic member 320 being fixed to the corresponding board 100*a* or 100*b* and the steering means 300*a*, respectively, and a pair of caster means 310, which are installed to face each other, capable of being steered and rolled by means of bearings 313 provided at both sides of the steering means 300*a* so that a twisting force of the elastic members 320 generated from rolling of the pair of boards 100*a* and 100*b* accelerates the voluntarily advancing pair of caster means 310 to allow the pair of boards 100*a* and 100*b* to be more elastically moved forward in an alternating manner while the pair of boards are disaligned.

As shown in FIGS. 6*a*, 6*b*, 7*a* and 7*b*, each of the steering means 300*a* includes a steering block 300*b* having a coupling hole 301 at its center, an elastic member 320 generating a twisting force, a main steering shaft 330 having the elastic member 320 accommodated and coupled to the coupling hole 301 of the steering block 300*b*, a twist cover 350 for fixing the lower portion of the elastic member 320 to the steering means 300*a*, and a fixing means 360 for securing the main steering shaft 330 to the slope 104.

The steering block 300*b* has the coupling hole 301, through which the main steering shaft 330 penetrates, formed at its center, a coupling groove 302 in a multiple step shape formed at the end portion of the coupling hole 301 so as to be communicated with the coupling hole 301, and a rotation-preventing recess 303 partially protruded from the inner circumference of the coupling groove 302 toward the outside of the coupling groove.

The elastic member 320 is in the form of a rectangular plate. In each of the pair of the boards 100*a* and 100*b*, only one elastic member 320 may be installed. Alternatively, a plurality of thin elastic members 320 may be joined together. In the latter case, the number of the elastic members 320 can be determined to obtain the most optimal twisting force taking into consideration the ability of a user to operate the voluntarily advancing board or body weight of the user.

The main steering shaft 330 accommodates the elastic member 320 in a perpendicular downward position so as to allow the upper and lower portions of the elastic member 320 to be partially exposed to the outside.

That is, the main steering shaft 330 includes: a fixing shaft 331 having a fixing hole 332 formed at its center so as to accommodate the elastic member 320 therein, a flange 333 formed at the upper portion of its outer circumference, and a male thread 334 formed at the lower portion of its outer circumference; and a support block 345 coupled to the outer circumference of the fixing shaft 331 so as to be attached to the lower end of the flange 333 and provided with a bearing 345*a* so as to be smoothly rotated about the fixing shaft 331.

The twist cover 350 is provided to fixedly connect the main steering shaft 330 to the steering means 300*a* so as to be fixed to the steering means 320*a* while being coupled with the lower portion of the elastic member 320 exposed to the outside, thereby allowing the pair of boards 100*a* and 100*b* and the voluntary advancement assembly 300 to twist the elastic member 320 in the opposite direction during rolling of the pair of boards 100*a* and 100*b*.

The twist cover 350 is in the form of a cover having an open bottom, and is configured to include: a fixing protrusion 352; an insertion slot 351 formed at the center of the inner surface of the fixing protrusion 352 to insert the elastic member 320 partially exposed from the lower portion of the main steering shaft 330 thereinto; a rotation-preventing protrusion 353 formed on the outer circumference of the twist cover to be fitted into the rotation-preventing recess 303 of the steering block; and a fastening member (not shown) for fixing the rotation-preventing protrusion 353 to the rotation-preventing recess 303, so that the upper portion of the elastic member 320 is integrated with the voluntary advancement assembly 300.

The main steering shaft 330 coupled to the steering means 300*a* is secured to the fixing means 360 through the slope 104.

At this time, the coupling hole, through which the main steering shaft 330 penetrates, is formed at the center of the steering means 300*a*, the coupling groove 302 is formed to accommodate the support block 345 of the main steering shaft 330 while being communicated with the coupling hole 301, and the rotation-preventing recess 303 is formed on the inner circumference of the coupling groove 302 by partial incision to allow the rotation-preventing protrusion 353 to be fitted thereinto, so that the main steering shaft 330 is tightly fixed to the steering means 300*a*.

In the fixing means 360, a polygonal fixing member 361 is engaged with the male thread 334 of the main steering shaft 330 through a fixing hole 104*a* formed on the slope 104 to integrally fix the support block 345 to the main steering shaft 330 by a pressure of the flange 333, and is fitted into a fixing protrusion 105 having the same polygonal shape as the fixing member 361; and a fastening member 362 is engaged with the male thread 334 of the main steering shaft 330 through the fixing hole 104*a* formed in the corresponding board 100*a* or 100*b* to integrally fix the main steering shaft 330 coupled with the steering means 300*a* to the slope 104 of the board 100*a* or 100*b*.

Rolling rotatable casters (not shown) are coupled to respective brackets 311 in the form of forks, and bearings 313 are provided at the upper portions of the respective brackets 311 to install the pair of caster means 310 at both sides of the steering means 300*a*, thereby achieving voluntary steering rotation of the pair of caster means 310 and the steering means 300*a*.

A slide-preventing cover 106 is configured to include a plurality of projections 107*e* exposed to the outside through the corresponding board to prevent rider's footing from being lost, and a rotation-preventing means 107 formed on the lower surface of the slide-preventing cover 106 to fix the upper portion of the elastic member 320 wherein the rotation-preventing means 107 has a protruded block 107*b* formed on the lower surface of the slide-preventing cover 106, an introduction recess 107*a* formed in the protruded block 107*b*, an insertion block 107*c* fitted into the protruded block 107*b* and an insertion slot 107*d* formed in the insertion block 107*c* to insert the upper portion of the elastic member 320 thereinto.

The introduction recess 107*a* preferably has the same polygonal shape as the insertion block 107*c* to prevent the slide-preventing cover from being rotated.

In an alternative embodiment, the rotation-preventing means 107 may be configured to insert a rotation-preventing block 346 into the fixing hole 332 formed at the lower end of the fixing shaft 331 so that the lower end of the elastic member 320 partially exposed to the outside from the lower end of the fixing shaft 331 is inserted into an insertion slot 346*a* formed at the lower end of the rotation-preventing block 346.

The steering block 300*b* of the steering means 300*a* allowing rotation of the pair of caster means 310 is configured to have fixing holes and angle-adjusting grooves 304 having the same center of curvature as the respective fixing holes, and each of the pair of caster means 310 is provided with a bracket 311 inserted into the corresponding fixing hole and a stopper 312 projected from the upper end of the bracket 312 to be introduced into the corresponding angle-adjusting groove 304 so that the rotational angle of the caster means 310 rotatably mounted to the steering means 300*a* can be limited.

The rear board 100*b* is configured to include an interference-preventing groove 103 formed on the lower surface of the rear board to prevent both end portions of the steering means 300*a*, which is mounted to the slope 104 and is rotated within a particular angle range, from interfering with each other wherein the interference-preventing groove 104 has an arc shape identical to the track of the rotational movement of the steering means 300*a*.

An explanation of the operational mechanism in which a twisting force of the voluntarily advancing board according to the present invention is generated will be provided below.

First, the voluntary advancement assemblies 300 are inclinedly rotated on the respective slopes 104 by rolling so that the pairs of caster means 310 are moved forward in an alternating manner while being disaligned. The upper portions of the elastic members 320 inserted into the respective insertion slots 107*d*, which are formed in the slide-preventing covers 106 of the respective boards 100*a* and 100*b*, are twisted with respect to the lower portions of the elastic members 320 inserted into the respective insertion slots 351, which are formed in the twist covers 350 in association with the respective voluntary advancement assemblies 300, to generate a twisting force.

When a rider removes his/her center of gravity from the voluntarily advancing board or shifts the center of gravity into the opposite direction to continue rolling, the front and rear boards 100*a* and 100*b* disaligned by the twisting force of the elastic members 320 are elastically restored to their original positions. When the rider rolls the front and rear boards 100*a* and 100*b* in the directions opposite to each other, the voluntary advancement assemblies 300 are inclinedly rotated in the opposite directions to repeatedly generate a twisting force of the elastic members 320. As a result, the front and rear boards 100*a* and 100*b* can be elastically rolled.

According to the present invention, the front and rear boards 100*a* and 100*b* are rolled to generate a voluntary forward force, and at the same time, the twisting force of the elastic members 320 allows the elastic members 320 to be rapidly restored to the original positions after the repeated rolling operations, resulting in an improvement in the forward force and instantaneous steerability of the voluntarily advancing board 100.

MODE FOR INVENTION

The operation of the voluntarily advancing board according to the present invention will be explained below.

With reference firstly to FIG. 11, more detailed explanation of the forward moving state of the voluntarily advancing board according to the present invention will be given below.

A rider intentionally rolls the voluntarily advancing board 100 such that the front board 100*a* is inclined to (L) side and the rear board 100*b* is inclined to (R) side.

Inclination of the front board to (L) side allows the caster means 310 provided at (L) side with respect to the main steering shaft 330 to act as a support point and the caster means 310 provided at (R) side with respect to the main steering shaft 330 to be moved forward while being turned.

At the same time, when the rear board 100*b* is inclined to (R) side, the caster means 310 provided at (R) side with respect to the main steering shaft 330 acts as a support point and the caster means 310 provided to (L) side with respect to the main steering shaft 330 is moved forward while being turned.

By such alternating rolling of the front and rear boards 100*a* and 100*b*, one caster means of the caster means 310 provided at (R) and (L) sides is rolled and moved forward in the inclined direction.

The reason for this rolling and forward movement is as follows. As shown in FIG. 12, when the front and rear boards 100*a* and 100*b* are rotated at predetermined steering angles in the state of being adhered to the ground by the steering means 300*a* mounted to the respective slopes 104, component forces F1 (F1 cos $\alpha$) and F2 (F2 cos $\beta$) are generated in the slant directions with respect to the initial position to allow the front and rear boards 100*a* and 100*b* to be moved forward in F1 and F2 directions, respectively.

Thereafter, when the rider removes the alternating rolling force from the front and rear boards 100*a* and 100*b* to remove the twisting force applied to the elastic members 320, the positions of the voluntary advancement assemblies 300 are aligned to the central line, which corresponds to the initial positions of the front and rear boards 100*a* and 100*b*, due to a restoring force of the elastic members 320, thereby recovering balance of the front and rear boards 100*a* and 100*b* and enabling the front and rear boards 100*a* and 100*b* to be moved forward in a uniform straight-line motion due to the existing acceleration.

Continuously, the rider intentionally rolls the voluntarily advancing board 100 such that the front board 100*a* is inclined to (R) side and the rear board 100*b* is inclined to (L) side.

Inclination of the front board to (R) side allows the caster means 310 provided at (L) side with respect to the main steering shaft 330 to act as a support point and the caster means 310 provided at (R) side with respect to the main steering shaft 330 to be moved forward while being turned.

At the same time, when the rear board 100*b* is inclined to (L) side, the caster means 310 provided at (L) side with respect to the main steering shaft 330 acts as a support point and the caster means 310 provided to (R) side with respect to the main steering shaft 330 is moved forward while being turned.

That is, the voluntarily advancing board 100 can be rapidly and quickly rolled in the advancing direction by quickly and repeatedly inclining the front and rear boards 100*a* and 100*b* to (R) and (L) sides through displacement of the center of gravity or force, and as a result, the voluntarily advancing board 100 can be moved in a wave-like motion with a short pitch.

Due to this torsional elastic force of the voluntary advancement assemblies 300, the pairs of caster means 310 mounted to the front and rear boards 100*a* and 100*b* can be gradually and voluntarily moved forward, and as result, the forward speed of the voluntarily advancing board 100 can be increased despite a low rolling force.

The forward movement of the voluntarily advancing board 100 can be achieved by rolling the board 100 in one direction to incline the steering means 300*a* to the selected direction to allow the caster means 310 provided in the inclined direction to act as support points and the caster means 310 provided in the opposite direction to be moved forward while being turned.

Furthermore, the voluntary advancement assemblies 300 capable of voluntary forward movement coupled to the respective front board 100*a* and the rear board 100*b* can enhance the forward force of the voluntarily advancing board.

The foregoing embodiments and accompanying drawings do not serve to limit the scope of the present invention. Accordingly, those skilled in the art will appreciate that various substitutions, modifications and changes are possible, without departing from the technical spirit of the present invention as disclosed in the accompanying claims.

The invention claimed is:

1. A board capable of voluntary forward movement, the board comprising:

a pair of front and rear boards, each of which is integrated with a connecting step formed on its lower surface and includes a connecting hole formed within the connecting step, a slope formed protrudedly at a lateral side of the connecting step and a slide-preventing cover being attached to an upper surface of the front and rear boards, the connecting holes being communicated with each other;

a connecting assembly including a connecting pipe inserted into the connecting holes, fixing blocks rotatably coupled to both ends of the connecting pipe to integrally connect the front board and the rear board, each of the fixing blocks having a track groove, and coupling pins inserted into the track grooves through the connecting pipe to be in association with the connecting pipe so that the front and rear boards are rotated within limited angle ranges corresponding to predetermined widths of the track grooves; and voluntary advancement assemblies, each of which includes a steering means having a steering block and rotatably mounted to the slope formed at a lower side of the corresponding board so as to be inclined toward the rear of the pair of boards, a main steering shaft provided with an elastic member and coupled to the steering block, both ends of the elastic member being fixed to the corresponding board and the steering means, respectively, and a pair of caster means, which are installed to face each other at both sides of the steering means, capable of being steered and rolled by means of bearings provided at both sides of the steering means so that a twisting force of the elastic member generated from rolling of the pair of boards allows the pairs of caster means to be elastically moved forward in an alternating manner while the pairs of caster means are disaligned; and said steering block having a coupling hole formed at its center, a coupling groove in a multiple step shape formed at an end portion of the coupling hole to be communicated with the coupling hole, and a rotation-preventing recess partially protruded from an inner circumference of the coupling groove toward the outside of the coupling groove;

said main steering shaft accommodating the elastic member in a perpendicular downward position so as to allow upper and lower portions of the elastic member to be partially exposed to the outside;

a twist cover coupled with the lower portion of the elastic member exposed to the outside and fixed to the coupling groove of the steering block; and a fixing means for securing the main steering shaft to the corresponding board through the slope.

2. The board according to claim 1, wherein the main steering shaft includes:

a fixing shaft having a fixing hole formed at its center so as to accommodate the elastic member therein, a flange formed at an upper portion of its outer circumference, and a male thread formed at a lower portion of its outer circumference; and a support block coupled to the outer circumference of the fixing shaft so as to be attached to the lower end of the flange and provided with a bearing so as to be smoothly rotated about the fixing shaft.

3. The board according to claim 1, wherein the slide-preventing cover includes a plurality of projections exposed to the outside through the corresponding board and a rotation-preventing means formed on a lower surface of the slide-preventing cover to fix the upper portion of the elastic member, the rotation-preventing means having a protruded block formed on a lower surface of the slide-preventing cover, an introduction recess formed in the protruded block, an insertion block fitted into the protruded block and an insertion slot formed in the insertion block to insert the upper portion of the elastic member thereinto.

4. The board according to claim 3, wherein the rotation-preventing means is configured to insert a rotation-preventing block into the fixing hole formed at an upper end of the fixing shaft so that the upper portion of the elastic member partially exposed to the outside from the upper end of the fixing shaft is inserted into an insertion slot formed at a lower end of the rotation-preventing block.

5. The board according to claim 1, wherein the twist cover is in the form of a cover having an open bottom, and includes: a fixing protrusion; an insertion slot formed at the center of the inner surface of the fixing protrusion to insert the elastic member partially exposed from the lower portion of the main steering shaft thereinto; a rotation-preventing protrusion formed on an outer circumference of the twist cover to be fitted into the rotation-preventing recess of the steering block; and a fastening member for fixing the rotation-preventing protrusion to the rotation-preventing recess.

6. The board according to claim 1, wherein the fixing means include: a polygonal fixing member engaged with the male thread of the main steering shaft to integrally fix the support block to the main steering shaft and to position the support block at an entrance end of a fixing hole formed in the slope of the corresponding board, and fitted into a fixing protrusion having the same polygonal shape as the fixing member; and a fastening member engaged with the male thread of the main steering shaft through the fixing hole to integrally fix the main steering shaft coupled with the steering means to the slope of the corresponding board.

7. The board according to claim 1, wherein the steering block of the steering means allowing rotation of the pair of caster means has fixing holes and angle-adjusting grooves, each of which has the same center of curvature as the corresponding fixing hole, formed at lateral sides of the respective fixing holes; and each of the pair of caster means is provided with a bracket inserted into the corresponding fixing hole and a stopper projected from an upper end of the bracket to be introduced into the corresponding angle-adjusting groove so that the rotational angle of the caster means rotatably mounted to the steering means is limited.

8. The board according to claim 1, wherein the rear board includes an interference-preventing groove formed on a lower surface of the rear board to prevent both end portions of the steering means, which is mounted to the slope and is rotated within a particular angle range, from interfering with each other, and the interference-preventing groove having an arc shape identical to the track of the rotational movement of the steering means.

9. The board according to claim 1, wherein each of the fixing blocks of the connecting assembly has a plurality of length-adjusting holes perpendicularly formed at regular intervals in front of the corresponding track groove, the corresponding board being secured to the connecting assembly by means of a fastening member through one hole selected from the length-adjusting holes so that the distance between the pair of front and rear boards is optionally controlled.

10. The board according to 1, wherein the main steering shaft includes:

a fixing shaft having a fixing hole formed at its center so as to accommodate the elastic member therein, a flange formed at an upper portion of its outer circumference, and a male thread formed at a lower portion of its outer circumference; and a support block coupled to the outer circumference of the fixing shaft so as to be attached to the lower end of the flange and provided with a bearing so as to be smoothly rotated about the fixing shaft.

11. The board according to 1, wherein the rear board includes an interference-preventing groove formed on a lower surface of the rear board to prevent both end portions of the steering means, which is mounted to the slope and is rotated within a particular angle range, from interfering with each other, and the interference-preventing groove having an arc shape identical to the track of the rotational movement of the steering means.

* * * * *